US010945910B2

(12) United States Patent
Picazo

(10) Patent No.: US 10,945,910 B2
(45) Date of Patent: Mar. 16, 2021

(54) STANDING FRAME FOR USERS WITH STANDING CHALLENGES AND METHOD

(71) Applicant: Joaquin Veytia Picazo, Escondido, CA (US)

(72) Inventor: Joaquin Veytia Picazo, Escondido, CA (US)

( * ) Notice: Subject to any disclaimer, the term of this patent is extended or adjusted under 35 U.S.C. 154(b) by 0 days.

(21) Appl. No.: 16/506,917

(22) Filed: Jul. 9, 2019

(65) Prior Publication Data

US 2020/0016022 A1 Jan. 16, 2020

Related U.S. Application Data

(60) Provisional application No. 62/698,180, filed on Jul. 15, 2018.

(51) Int. Cl.
*A61H 3/00* (2006.01)

(52) U.S. Cl.
CPC ..... *A61H 3/008* (2013.01); *A61H 2003/002* (2013.01); *A61H 2003/005* (2013.01); *A61H 2003/006* (2013.01); *A61H 2003/007* (2013.01)

(58) Field of Classification Search
CPC ..... A61H 3/008; A61H 2003/007; A61H 2003/005; A61H 1/00
See application file for complete search history.

(56) References Cited

U.S. PATENT DOCUMENTS

| | | | | |
|---|---|---|---|---|
| 2,210,269 | A | 8/1940 | Taylor | |
| 3,107,105 | A | 10/1963 | Heriford | |
| 4,111,445 | A | 9/1978 | Haibeck | |
| 4,456,086 | A | 6/1984 | Wier et al. | |
| 4,744,578 | A | 5/1988 | Stearns | |
| 4,807,897 | A | 2/1989 | Schultz | |
| 4,948,156 | A | 8/1990 | Fortner | |
| 4,968,050 | A | 11/1990 | Kendrick et al. | |
| 5,242,180 | A | 9/1993 | Bergeron | |
| 5,490,687 | A | 2/1996 | Scholl | |
| 5,884,935 | A | 3/1999 | Tholkes | |
| 7,036,512 | B2 | 5/2006 | Harnois | |
| 7,540,045 | B2 * | 6/2009 | Nativ | A61G 7/1015 5/86.1 |
| 9,084,501 | B2 | 7/2015 | Pearson | |
| 2008/0041282 | A1 * | 2/2008 | Goschy | A61G 5/1094 108/141 |
| 2011/0040349 | A1 | 2/2011 | Graupe | |
| 2014/0128782 | A1 | 5/2014 | Williamson, III et al. | |

FOREIGN PATENT DOCUMENTS

DE 202007010996 U1 * 10/2007 ..... A61H 3/008

* cited by examiner

*Primary Examiner* — James A Shriver, II
*Assistant Examiner* — James J Triggs
(74) *Attorney, Agent, or Firm* — Michael D. Eisenberg

(57) ABSTRACT

A standing frame to assist a user with stand challenges in standing, comprising a base assembly that accommodates the user's feet; a stand assembly supported by the base assembly; a handlebar assembly supported by the stand assembly and configured to receive one or more of a user's hands and arms to rest thereon; a securement assembly coupled to the stand assembly to secure the user to the standing frame; and a knee support assembly configured to receive the user's knees to rest thereon.

13 Claims, 8 Drawing Sheets

STANDING FRAME FOR USERS WITH STANDING CHALLENGES AND METHOD

CROSS-REFERENCE TO RELATED APPLICATION

This application claims the benefit of provisional application No. 62/698,180, filed Jul. 15, 2018, which is incorporated by reference herein.

FIELD OF THE INVENTION

The present invention relates to standing frames for users with standing challenges.

BACKGROUND OF THE INVENTION

Standing frames for users with standing challenges in the past have suffered from a number of drawbacks, such as, but not limited to, they are too complex, there are too many moving parts which can equate to breakdowns, broken parts, etc. (e.g., some standing frames including hydraulics), standing frames are very expensive (insurance companies won't pay because they are not considered a medical necessity), size of standing frames and/or design is big, bulky and unmaneuverable for a wheelchair user, the weight is too heavy to relocate the standing frame (most wheelchair users don't have the ability to relocate a standing frame after it was put together with assistance), on wheels (from a user's prospective, standing on a standing frame with wheels, is uncomfortable and/or dangerous), standing frames do not have arm rests (standing upright with one's arms at one's side is very uncomfortable and makes standing unbearable over time), standing frames do not include a desktop (there is no place to put one's laptop or computer to be productive while standing, which is important for studying or watching one's favorite educational programs), standing frames do not include a USB Port for Smart Devices, a 3 prong outlet to charge one's computer, nor a built-in cup holder to secure a beverage or refreshment, and most standing frames include a generic foot space to place one's feet, but the foot space is not customizable for different foot sizes.

SUMMARY OF THE INVENTION

An aspect of the present invention involves a standing frame to assist a user in standing comprising a base assembly that accommodates the user's feet; a stand assembly supported by the base assembly; a handlebar assembly supported by the stand assembly and configured to receive one or more of a user's hands and arms to rest thereon; a securement assembly coupled to the stand assembly to secure the user to the standing frame; and a knee support assembly configured to receive the user's knees to rest thereon.

One or more implementations of the immediately above aspect of the invention involves one or more of the following: the base assembly includes a pair of adjustable foot stop brackets laterally movable with respect to the base assembly and the user's feet to secure the user's feet to the base assembly; the base assembly includes an adjustable heel stop bar assembly longitudinally movable with respect to the base assembly to secure the user's feet to the base assembly; the base assembly includes a blocking bar assembly disposed between the pair of adjustable foot stop brackets; the base assembly includes a lateral base support, and adjustable feet locking areas defined by the adjustable foot stop brackets, the blocking bar assembly, the adjustable heel stop bar assembly, and the lateral base support; the blocking bar assembly is spring-loaded; the stand assembly includes a vertical stand support that is supported by the base assembly and an angled support coupled at one end to the vertical stand support and coupled at an opposite end to the base assembly; the handlebar assembly includes a vertical support that is telescopingly received in the vertical stand support to adjust a height of the standing frame; the handlebar assembly is a combination table and handlebar assembly; the combination table and handlebar assembly includes a rear portion with support handles; the combination table and handlebar assembly includes a front portion with a table; the combination table and handlebar assembly includes a frame and a support and adjustment mechanism coupled to the frame that allows the table to be longitudinally adjustable relative to the frame; the support and adjustment mechanism includes one or more pivots that allow the table to pivot forward to an out-of-the way position to make it easier for the user to get into and out of the standing frame; the table includes a side and a cup holder that is retractable and deployable from the side of the table; the securement assembly includes a belt assembly with a belt that is attachable and detachable relative to the stand assembly to secure the user to the standing frame; the knee support assembly includes a knee pad assembly with knee-receiving incurved sections that the user's knees are supported within; and/or a power assembly with one or more power outlets and one or more USB charge ports.

An aspect of the present invention involves a method of using the standing frame of the aspect of the invention described above, comprising: receiving a user's feet in base assembly; receiving a user's hands on the handlebar assembly; receiving a user's torso in the securement assembly to secure the user to the standing frame; receiving a user's knees on the knee support assembly; the handlebar assembly includes a table and handlebar assembly with a table, and the method further comprises receiving at least one of a user's hands and arms on the table; and/or the base assembly includes adjustable foot stop brackets, a blocking bar assembly, an adjustable heel stop bar assembly, and a lateral base support that together define adjustable feet locking areas to securely receive the user's feet.

BRIEF DESCRIPTION OF DRAWINGS

The preferred embodiments of the invention will hereinafter be described in conjunction with the appended drawings provided to illustrate and not to limit the invention, in which.

DESCRIPTION OF EMBODIMENT OF THE INVENTION

Figure 1:
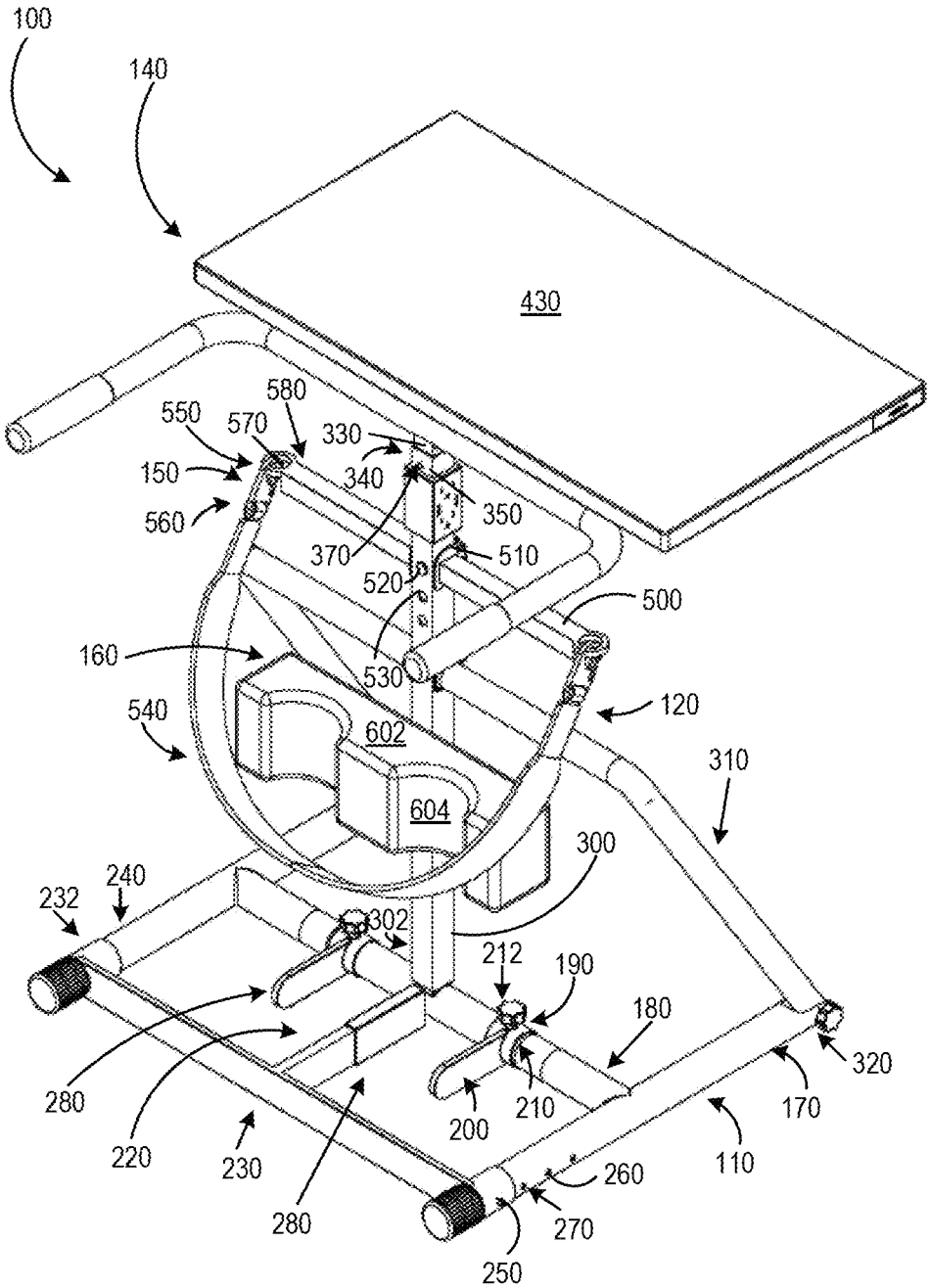
FIG. 1 is a perspective view of an embodiment of a standing frame for users with standing challenges.
Figure 2:
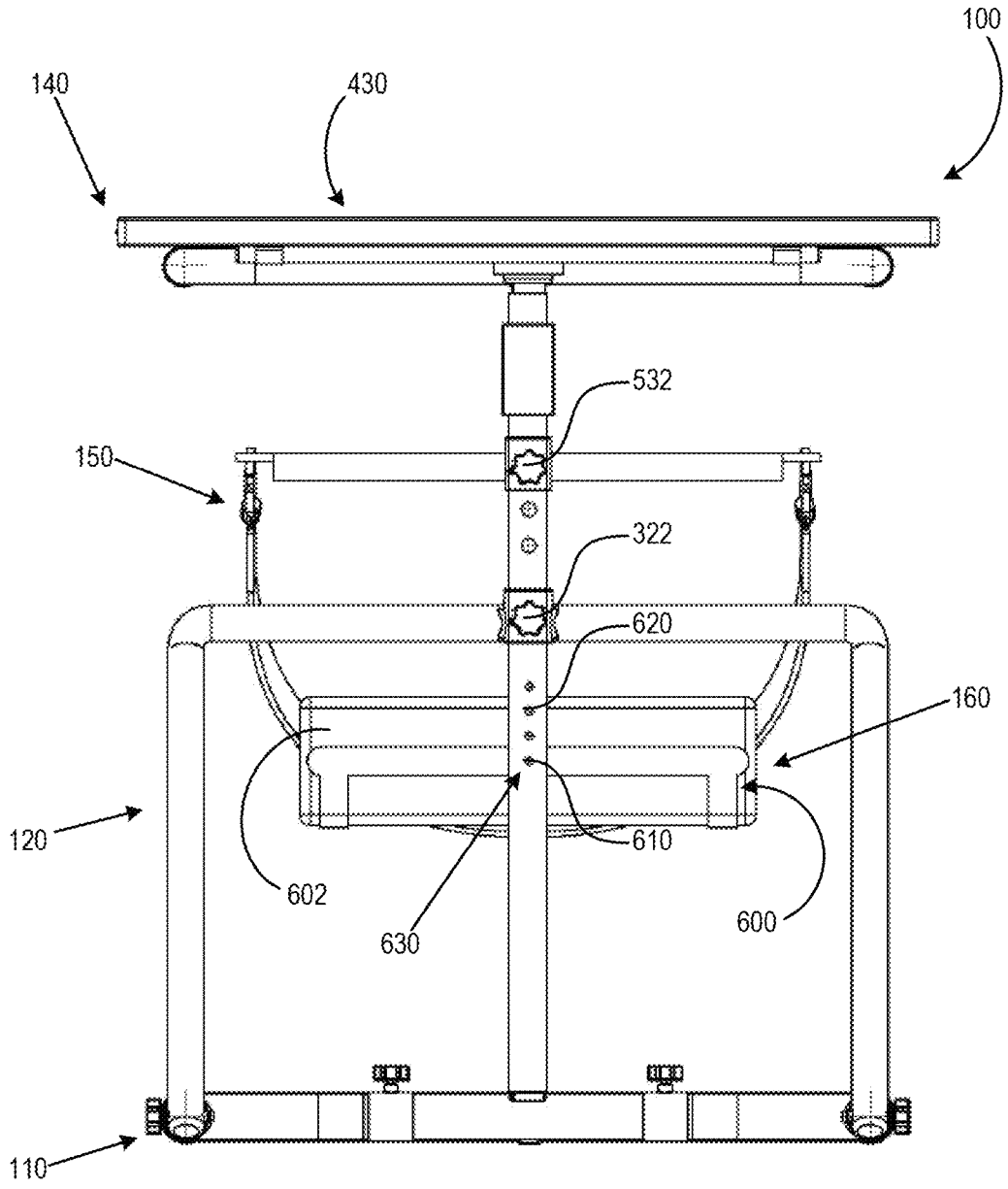
FIG. 2 is a front elevational view of an embodiment of a standing frame.
Figure 3:
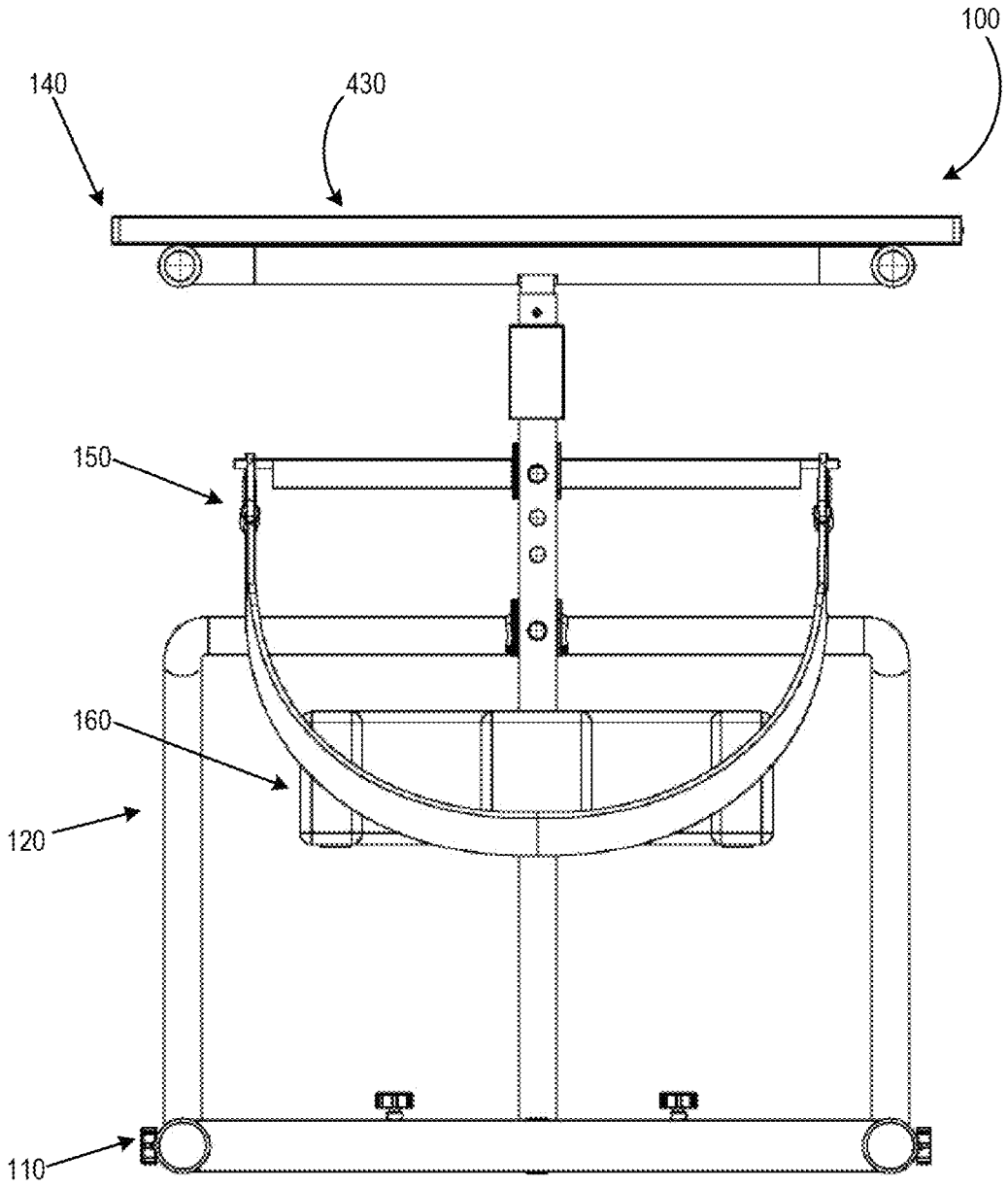
FIG. 3 is a rear elevational view of an embodiment of a standing frame.
Figure 4:
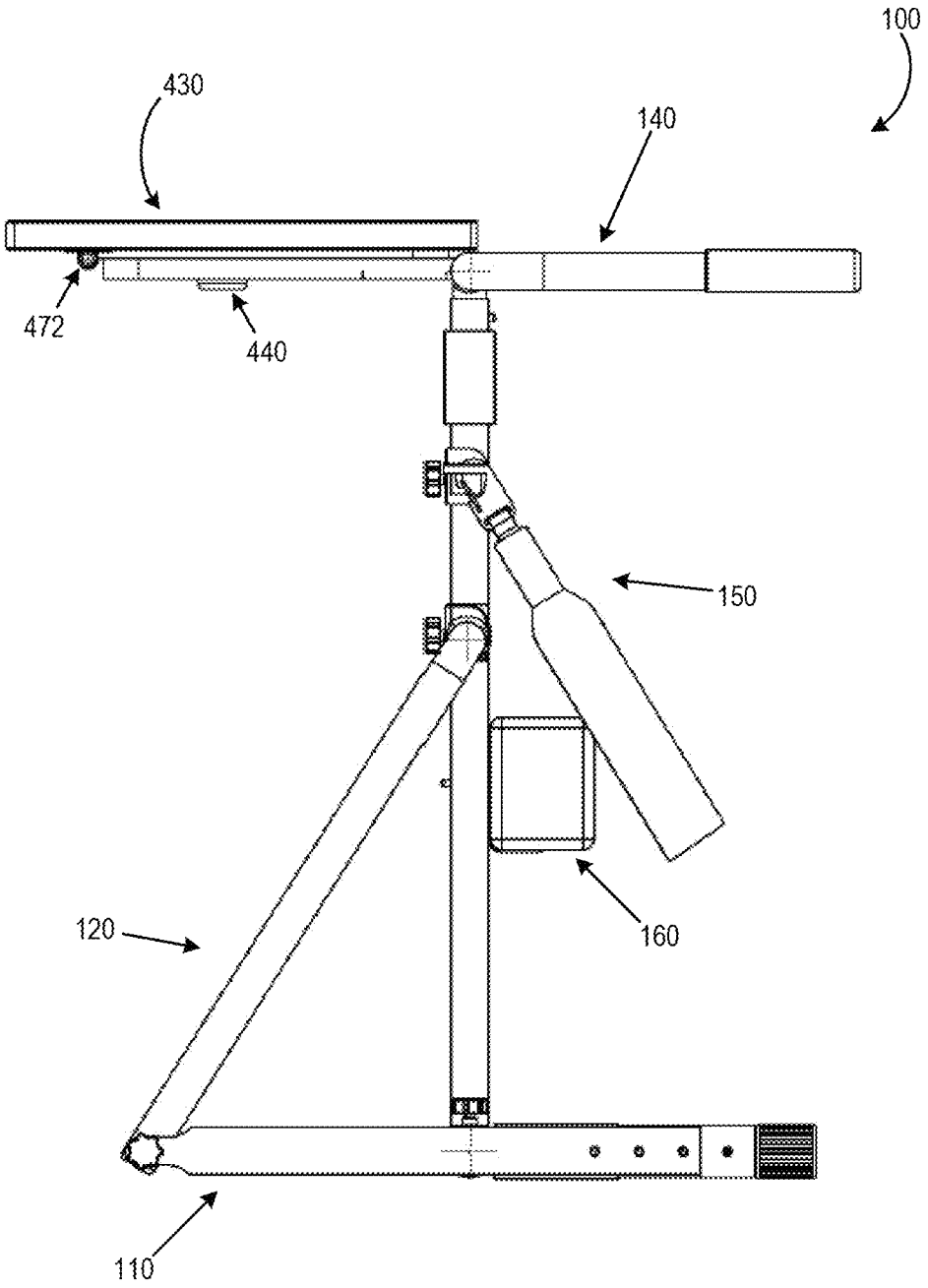
FIG. 4 is a right side elevational view of an embodiment of a standing frame.
Figure 5:
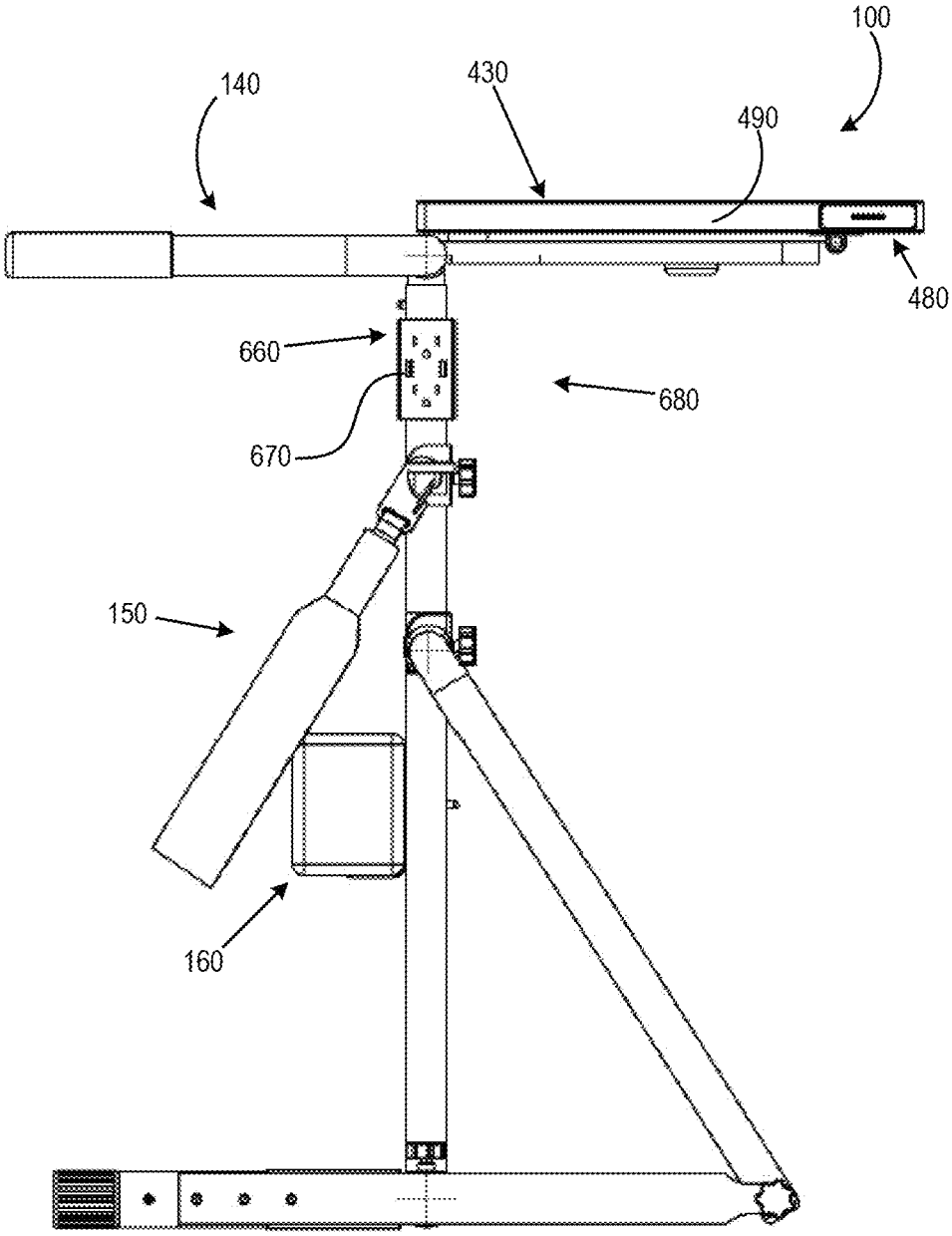
FIG. 5 is a left side elevational view of an embodiment of a standing frame.
Figure 6:
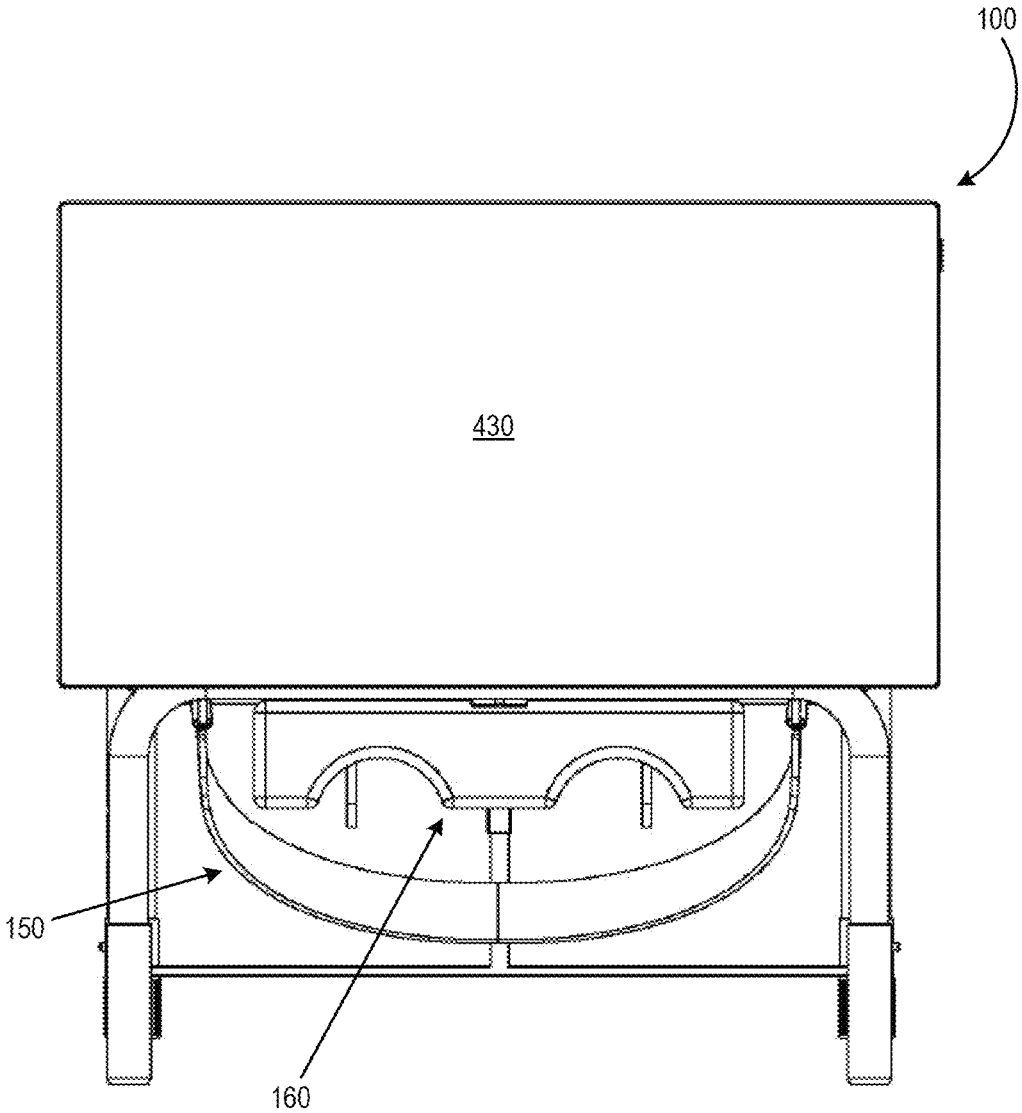
FIG. 6 is a top plan view of an embodiment of a standing frame.
Figure 7:
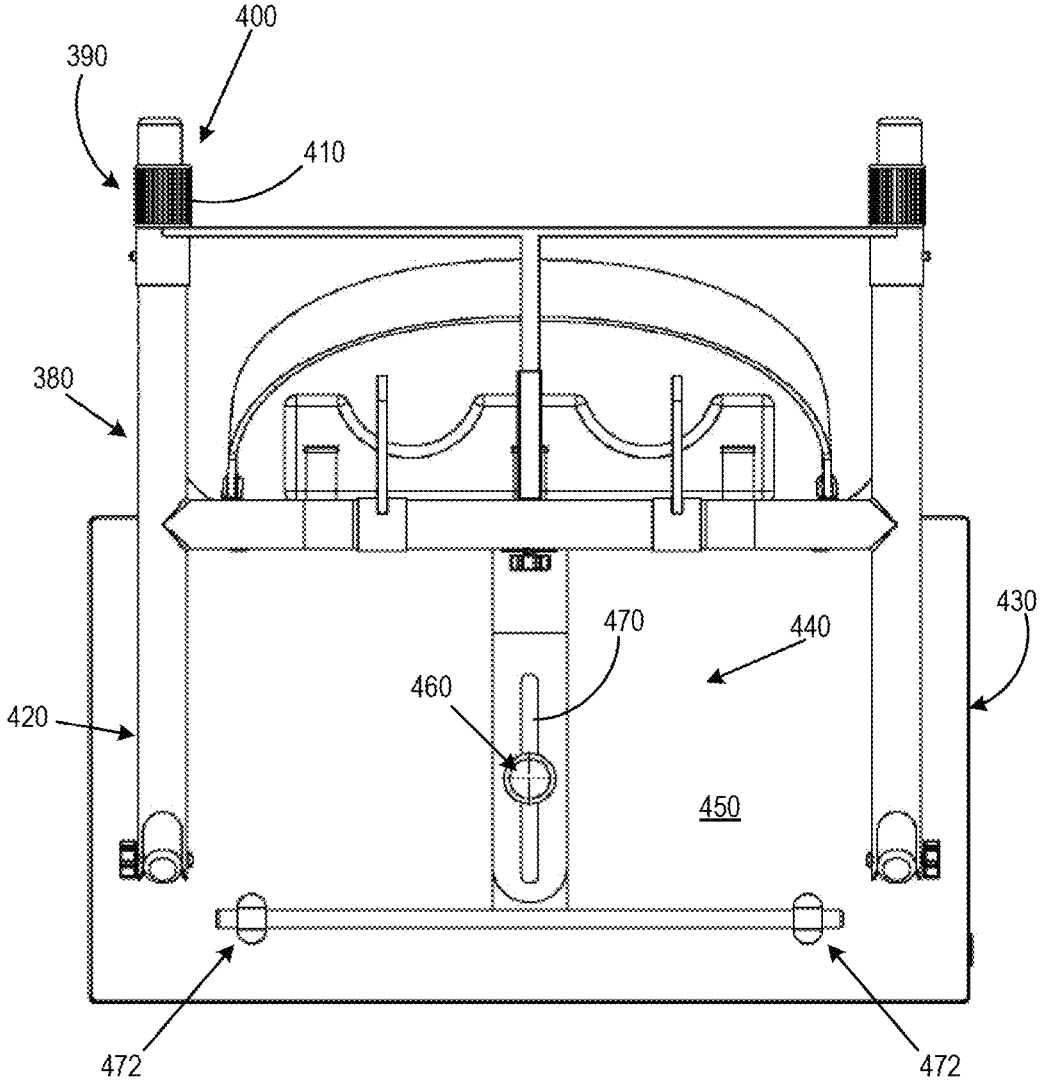
FIG. 7 is a bottom plan view of an embodiment of a standing frame.
Figure 8:
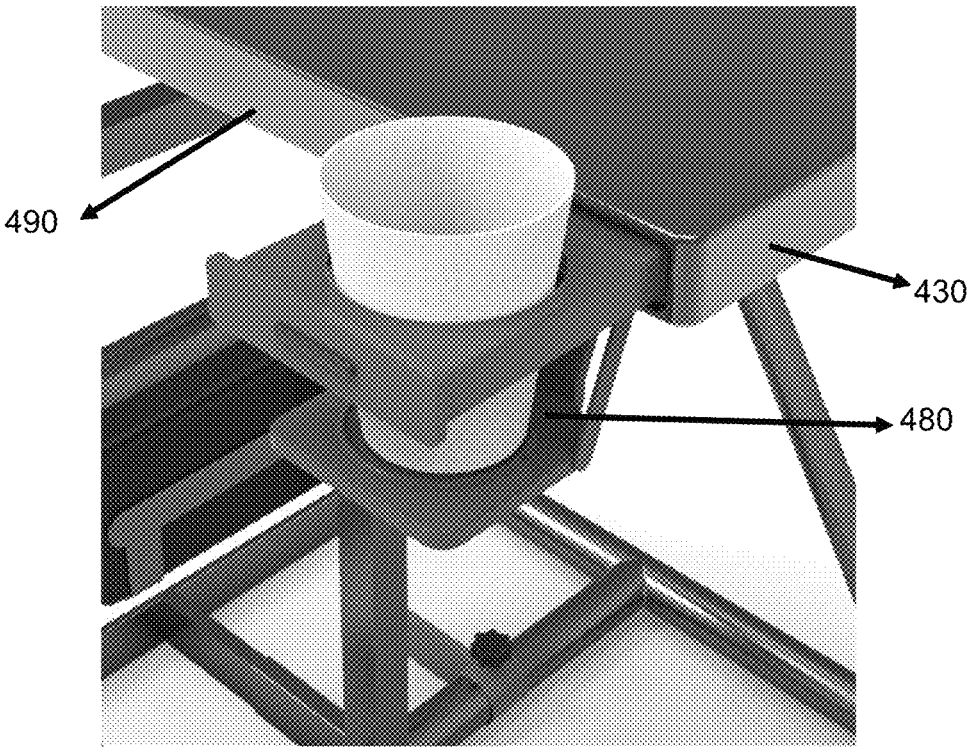
FIG. 8 is a perspective view of an embodiment of a cup holder that is deployable from a table of the standing frame.

With respect to FIGS. 1-8, an embodiment of a standing frame 100 for users who have standing challenges or are unable to stand independently because of a physical disability will be described. The standing frame 100 includes a base assembly 110, a stand assembly 120, a table and handlebar assembly 140, a belt assembly 150, and knee pad assembly 160.

The base assembly 110 includes a pair of longitudinal adjustable base supports 170 coupled together by a lateral base support 180. A pair of adjustable foot stop brackets 190 are movably coupled to the lateral base support 180. Each adjustable foot stop bracket 190 includes a tongue member 200, a collar 210 that slidably receives the lateral base support 180, and tensioning knob 212 that can be tightened/loosened for securing the adjustable foot stop bracket 190 in position on the lateral base support 180 or adjusting the position of the adjustable foot stop bracket 190 on the lateral base support 180. In a fixed central location between the longitudinal adjustable base supports 170 is a telescoping, spring-loaded blocking bar assembly 220. The blocking bar assembly 220 is perpendicularly disposed relative to an adjustable heel stop bar assembly 230, which includes opposite collar portions 232 that telescopingly receive end portions 240 of the longitudinal adjustable base supports 170. Holes 250, 260 in the end portions 240 and longitudinal adjustable base supports 170 are operatively associated with a detent spring button 270 to adjust the position of the adjustable heel stop bar assembly 230 to accommodate different sized shoes of a user. Adjustable feet locking areas 280 are created/defined by the tongue members 200 of the pair of adjustable foot stop brackets 190, the blocking bar assembly 220, the adjustable heel stop bar assembly 230, and the lateral base support 180.

The stand assembly 120 includes a vertical stand support 300 that is supported and joined at a bottom portion 302 with the lateral base support 180 of the base assembly 110. An angled support 310, which is pivotally connected to the longitudinal adjustable base supports 170 at end portions 320, is detachably coupled to the vertical support 300 via tensioning knob 322.

The table and handlebar assembly 140 includes a vertical table and handlebar support 330 that is telescopingly received in a top portion 340 of the vertical stand support 300. The top portion 340 and the vertical table and handlebar support 330 include holes 350 that are operatively associated with a detent spring button 370 to adjust the height of the table and handlebar assembly 140. The table and handlebar assembly 140 includes H-shaped frame 380. A rear portion 390 of the frame 380 includes support handles 400, which may include grips 410 thereon. A front portion 420 of the frame 380 supports a table 430. A T-shaped table support and adjustment mechanism 440 on an underside 450 of the table 430 is coupled to the frame 380 and includes a tensioning knob 460 disposed within slot 470 to secure the table 430 in a comfortable longitudinal position relative to the frame 380. Pivot(s) 472 of the T-shaped table support and adjustment mechanism 440 allow the table 430 to pivot forward 90 degrees to a vertical orientation (perpendicular to its normal flat/horizontal orientation) and in an out-of-the way position to make it easier for the user to get into and out of the standing frame 100. A hideable, built-in cup holder 480 is retractable/deployable from a side 490 of the table 430.

The belt assembly 150 includes a lateral belt support 500 joined to a hip belt bracket 510. The hip belt bracket 510 and the vertical stand support 300 include holes 520, 530 that are operatively associated with a tensioning knob 532 to adjust the height of the belt assembly 150. A hip belt 540 including carabiner clips 550 at opposite end portions 560 are detachably coupleable with loops 570 at opposite end portions 580 of the lateral belt support 500.

The knee pad assembly 160 includes a lateral support 600 and a knee cushion 602 carried by the lateral support 600. The knee cushion 602 includes knee-receiving incurved sections 604 that face rearwardly. The lateral support 600 and the vertical stand support 300 include holes 610, 620 that are operatively associated with a detent spring button 630 to adjust the height of the knee pad assembly 160.

A power assembly 650 with AC power outlets 660 and USB charge ports 670 is carried by the vertical stand support 300 above the belt assembly 150 and below the table and handlebar assembly 140 for one's smart devices. Although not shown, the power assembly 650 includes appropriate electronic circuitry (e.g., battery charged, solar charged, powered via power cord) for powering the power assembly 650.

In use, a user who has standing challenges approaches (e.g., with a wheelchair) the standing frame 100 and, with or without the help of an assistant, positions one's shoes/feet in feet locking areas 280 while gripping the support handles 400/grips 410 of the table and handlebar assembly 140. The table 430 is slid forward, allowing the user to get up and down from the standing frame 100. The user rests/supports one's knees in the knee-receiving incurved sections 604 of the knee pad assembly 160. One of the carabiner clips 550 is unclipped from one of the loops 570 and the hip belt 540 is positioned behind the hip of the user and then re-clipped to the same loop 570. The standing frame 100 is adjusted to fit the user's physical dimensions. One or more of the length and/or width of the feet locking areas 280 (to keep feet securely in place for stable stance and/or when in the process of standing), the height of the table 430 relative to the vertical stand support 300, the longitudinal position of the table 430 relative to the frame 380, the horizontal or vertical orientation of the table 430, the deployment of the hideable cup holder 480, the height of the belt assembly 150 (to support one's waist area and secure one's upright positioning), and the height of the knee pad assembly 160 (to keep one's knees locked and supported) may be adjusted/secured into position by the adjustment mechanisms of the standing frame 100 described above.

The standing frame 100 provides many physical contributions for the physically challenged user, but most importantly, the standing frame 100 improves a user's self-esteem, self-worth, and self-confidence. The standing frame 100 is fully adjustable for a personalized fit for each user; is constructed of hollow steel tubes, knobs, and detents for strength and adjustability, includes power and USB ports in order to charge electronic devices; includes an adjustable table that can be forward forward/rearward and/or oriented horizontal/vertical to facilitate ingress/egress/comfort and allows the user to rest a laptop, tablet, smart device; contains a hidden cup holder within table for convenient and secure containment of beverage without taking up table space; has arm rests and table to allow the user to rest one's hands and arms comfortably while standing (user no longer has to rest one's hands and arms along one's sides); and has a simple and sleek design, but affordable construction.

The above figures may depict exemplary configurations for the invention, which is done to aid in understanding the features and functionality that can be included in the invention. The invention is not restricted to the illustrated architectures or configurations but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus, the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A standing frame to assist a user with standing challenges in standing, comprising:

a base assembly that accommodates the user's feet;

a stand assembly supported by the base assembly, wherein the base assembly includes:

a pair of adjustable foot stop brackets laterally movable with respect to the base assembly and the user's feet to secure the user's feet to the base assembly;

an adjustable heel stop bar assembly longitudinally movable with respect to the base assembly to secure the user's feet to the base assembly; or a blocking bar assembly disposed between the pair of adjustable foot stop brackets;

a handlebar assembly supported by the stand assembly and configured to receive one or more of a user's hands and arms to rest thereon;

a securement assembly coupled to the stand assembly to secure the user to the standing frame;

a knee support assembly configured to receive the user's knees to rest thereon.

2. The standing frame of claim 1, wherein the base assembly includes a lateral base support, and adjustable feet locking areas defined by the adjustable foot stop brackets, the blocking bar assembly, the adjustable heel stop bar assembly, and the lateral base support.

3. The standing frame of claim 1, wherein the blocking bar assembly is spring loaded.

4. The standing frame of claim 1, wherein the stand assembly includes a vertical stand support that is supported by the base assembly and an angled support coupled at one end to the vertical stand support and coupled at an opposite end to the base assembly.

5. The standing frame of claim 1, wherein the handlebar assembly includes a vertical support that is telescopingly received in the vertical stand support to adjust a height of the standing frame.

6. The standing frame of claim 1, wherein the handlebar assembly is a combination table and handlebar assembly.

7. The standing frame of claim 6, wherein the combination table and handlebar assembly includes a rear portion with support handles.

8. The standing frame of claim 6, wherein the combination table and handlebar assembly includes a frame and a support and adjustment mechanism coupled to the frame that allows the combination table to be longitudinally adjustable relative to the frame.

9. The standing frame of claim 8, wherein the support and adjustment mechanism include one or more pivots that allow the combination table to pivot forward to an out-of-the way position to make it easier for the user to get into and out of the standing frame.

10. The standing frame of claim 6, wherein the combination table includes a side and a cup holder that is retractable and deployable from the side of the combination table.

11. The standing frame of claim 1, wherein the securement assembly includes a belt assembly with a belt that is attachable and detachable relative to the stand assembly to secure the user to the standing frame.

12. The standing frame of claim 1, wherein the knee support assembly includes a knee pad assembly with knee-receiving incurved sections that the user's knees are supported within.

13. The standing frame of claim 1, further including a power assembly with one or more power outlets and one or more USB charge ports.

* * * * *